US006113386A

United States Patent [19]

Shannon et al.

[11] Patent Number: 6,113,386

[45] **Date of Patent: *Sep. 5, 2000**

[54] METHOD AND APPARATUS FOR UNIFORMLY HEATING A FURNACE

[75] Inventors: Robert A. Shannon, Avon Lake, Ohio; Lawrence Vincent Rich, Caraopolis, Pa.; Frank Christian Gilbert, Brecksville, Ohio

[73] Assignee: North American Manufacturing Company, Cleveland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/169,634

[22] Filed: Oct. 9, 1998

[51] Int. Cl.[7] ..... F27B 9/28

[52] U.S. Cl. ..... 432/59; 432/8; 432/19; 432/24; 432/146

[58] Field of Search ..... 432/126, 127, 432/128, 136, 137, 138, 143, 144, 145, 146, 152, 153, 19, 20, 22, 24, 25, 26, 8, 59; 431/179, 178, 174

[56] References Cited

U.S. PATENT DOCUMENTS

| | | | |
|---|---|---|---|
| 2,297,696 | 10/1942 | Elder et al. . | |
| 2,849,221 | 8/1958 | Cone et al. . | |
| 3,002,736 | 10/1961 | Travis . | |
| 3,488,700 | 1/1970 | Iken et al. | 432/22 |
| 3,501,134 | 3/1970 | Knaak et al. . | |
| 3,612,498 | 10/1971 | Voigt | 432/128 |
| 3,726,515 | 4/1973 | Knaak | 432/25 |
| 3,851,091 | 11/1974 | Laws | 432/127 |
| 3,888,621 | 6/1975 | Williams | 432/19 |
| 4,095,929 | 6/1978 | McCartney . | |
| 4,473,388 | 9/1984 | Lauwers | 432/20 |
| 4,480,992 | 11/1984 | Okamoto | 432/18 |
| 4,484,947 | 11/1984 | Marshall | 75/380 |
| 4,496,306 | 1/1985 | Okigami et al. . | |
| 4,577,278 | 3/1986 | Shannon | 364/477.04 |
| 4,657,507 | 4/1987 | Kohama et al. | 432/18 |
| 4,927,357 | 5/1990 | Yap | 432/19 |
| 4,945,841 | 8/1990 | Nakamachi et al. . | |
| 5,052,921 | 10/1991 | Hemsath | 432/19 |
| 5,102,330 | 4/1992 | Ho | 432/103 |
| 5,149,265 | 9/1992 | Finke | 432/24 |
| 5,755,818 | 5/1998 | Tuson et al. | 432/22 |
| 5,855,639 | 1/1999 | Ougarane et al. | 432/19 |

FOREIGN PATENT DOCUMENTS

| | | |
|---|---|---|
| 2532922 | 2/1976 | Germany . |
| 2822329 | 12/1978 | Germany . |
| 2825430 | 3/1979 | Germany . |
| 58-024706 | 2/1983 | Japan . |
| 03153824 | 7/1991 | Japan . |

OTHER PUBLICATIONS

PCT International Search Report of Feb. 1, 2000, (7 pgs).

*Primary Examiner*—Denise L. Ferensic
*Assistant Examiner*—Jiping Lu
*Attorney, Agent, or Firm*—Jones, Day, Reavis & Pogue

[57] ABSTRACT

A method and apparatus is disclosed for heating metal billets or other separate pieces of metal in a continuous furnace using two different burner systems. The primary burner system provides the majority of available heat at relatively high flame temperatures. The secondary high velocity burner system extrains how furnace products of combustion that impinge around on the load. Thus, heat transfer and temperature uniformity is improved by forcing hot gases between the metal pieces.

8 Claims, 3 Drawing Sheets

METHOD AND APPARATUS FOR UNIFORMLY HEATING A FURNACE

BACKGROUND OF THE INVENTION

The present invention is directed to the field of continuous industrial furnaces used to heat metal billets or other separate pieces. A standard production furnace 10 is shown in FIGS. 1A and 1B. Units of product 12 are advanced through the furnace 10 along a movable hearth or beam 14. Burners 16 are fired into the furnace 10 so as to heat the product 12.

In a standard METAL Ras reheating application, it is typically desirable to heat a load to 2000–2400° F. This heating is achieved by firing burners 16 sufficient in size and number to establish a furnace thermal environment having products of combustion (POC's) at a temperature of 2000–2500° F. Burner flame temperatures are typically above 3000° F. Thus, care must be taken to ensure that the burner flame does not directly impinge upon the product 12, which affects grain growth, surface properties and creates excessive "scaling" which reduces the quality and quantity of useful product output. To this end, it is common to install burners 16 near the top of the furnace walls so that they fire horizontally, i.e. parallel to the top of the product 12, or mount radiant flat flame burners in the roof of the furnace 10, so as to preclude flame impingement. In some furnace configurations, the burners 16 can be placed to fire below the load.

There are drawbacks associated with the standard furnace design. Since burner firing occurs above and/or below the load, there tends to be an uneven thermal distribution within the furnace chamber. A boundary layer 18 exists which separates the load from a region 20 of the hot, radiant POC's exiting the burners 16. The spaces between and around the billets of product 12 tend to retain pockets 22 of stagnant furnace gas that are much cooler than the hot POC's in hot region 20. Thus, most of the heat is transferred to the product 12 by radiation from above to the top surface and fractional AREAS between pieces of the product 12, thereby limiting the rates of heat transfer to the product 12. Thus, the product 12 must spend a longer time in the furnace 10 in order to obtain the desired heating effect, resulting in reduced throughput productivity and greater energy consumption.

BRIEF DESCRIPTION OF THE INVENTION

In view of the drawbacks and disadvantages associated with previous systems, there is a need for a furnace heating system that provides a more uniform thermal distribution within a furnace chamber.

There is also a need for a furnace heating system that reduces pockets of colder, stagnant furnace gases.

There is also a need for a furnace heating system that compensates for hearth losses without over heating the product and/or damaging the working layer of a refractory hearth.

There is also a need for a furnace heating system with reduced product resident time and increased throughput.

There is also a need for a furnace heating system with increased fuel efficiency.

These needs and others are satisfied by the method and apparatus of the present invention in which a furnace heating system includes both a primary and a secondary burner system. The secondary burner system is designed to impinge upon and between the load, to provide increased rates of heat transfer the load.

As will be appreciated, the invention is capable of other and different embodiments, and its several details are capable of modifications in various respects, all without departing from the invention. Accordingly, the drawings and description are to be regarded as illustrative in nature and not restrictive.

DETAILED DESCRIPTION OF THE INVENTION

Figure 1A:
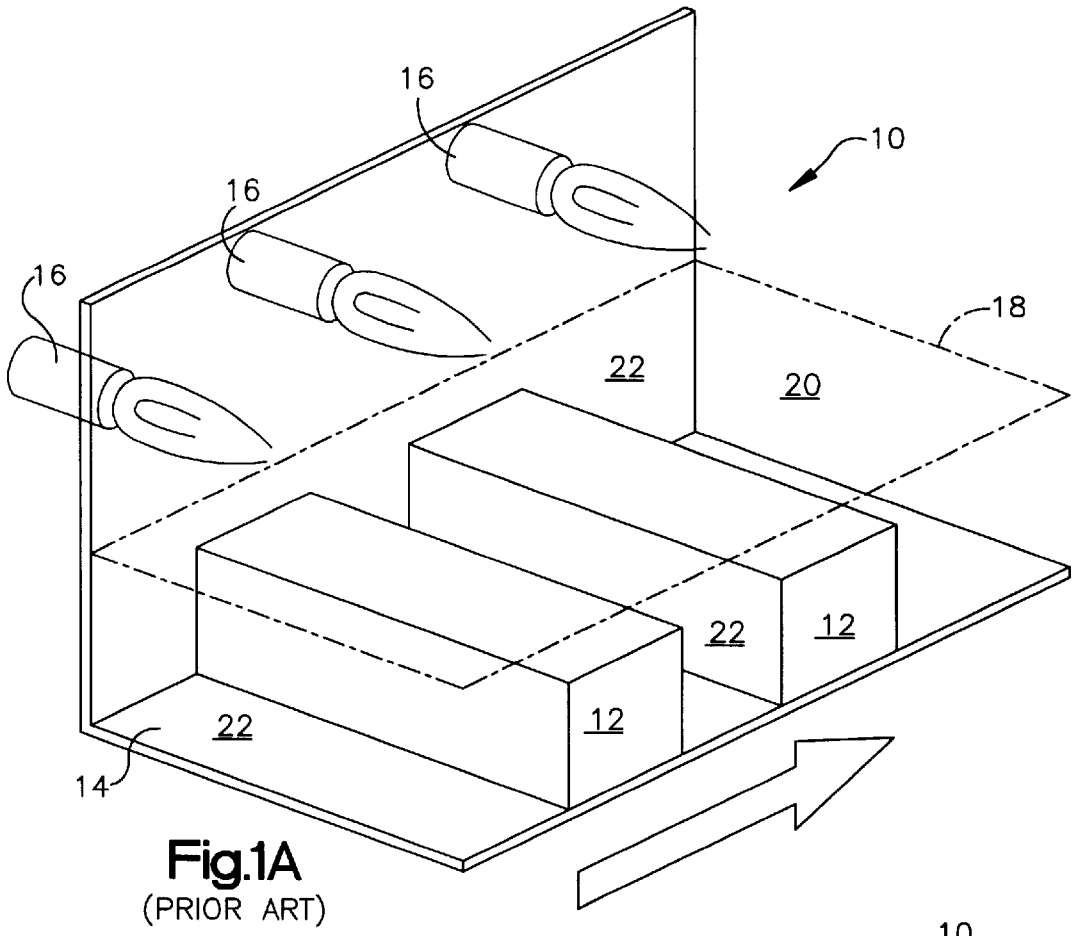
Fig.1A (PRIOR ART)
FIGS. 1A and 1B illustrate a previous type industrial furnace.
Figure 1B:
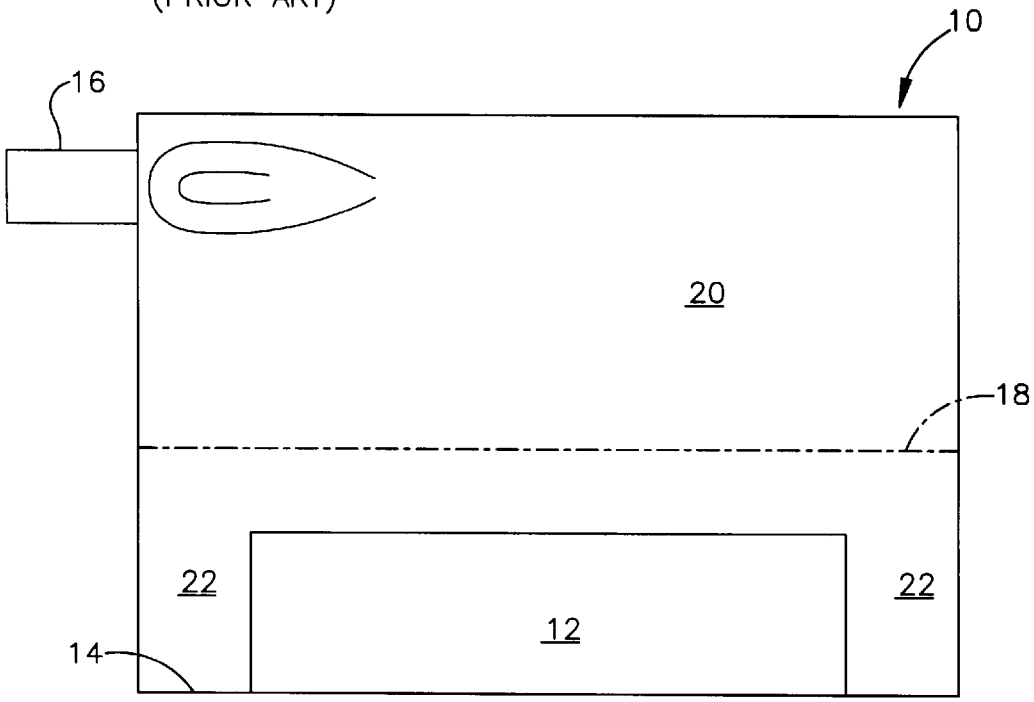
Fig.1B (PRIOR ART)
Figure 2A:
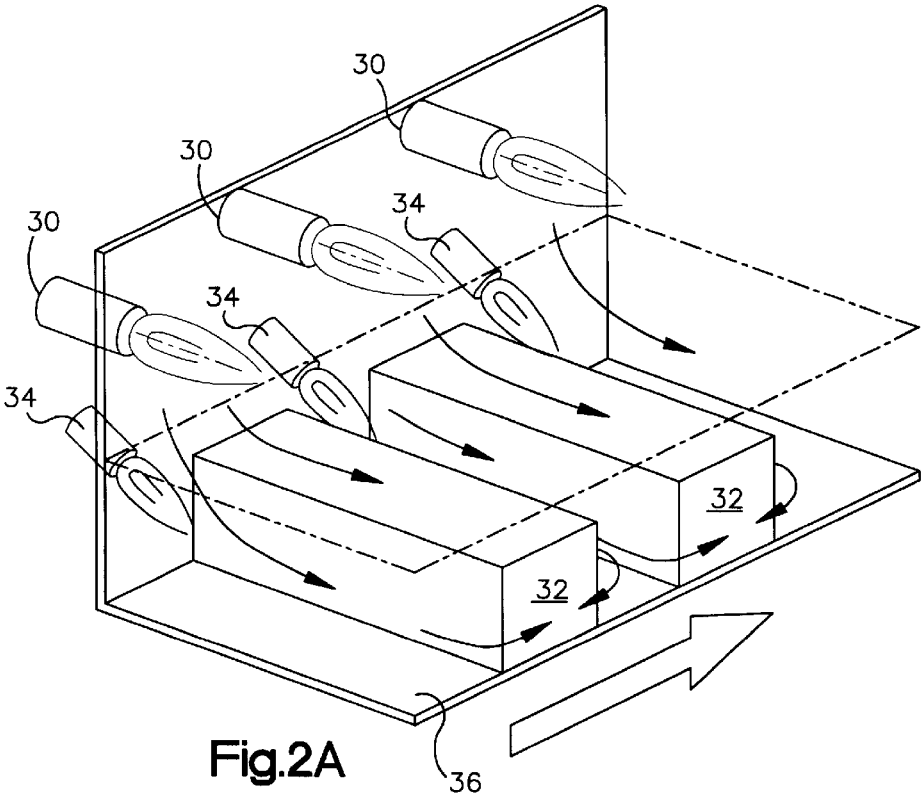
FIGS. 2A and 2B illustrate a possible furnace configuration that incorporating the heating system of the present invention.
Figure 2B:
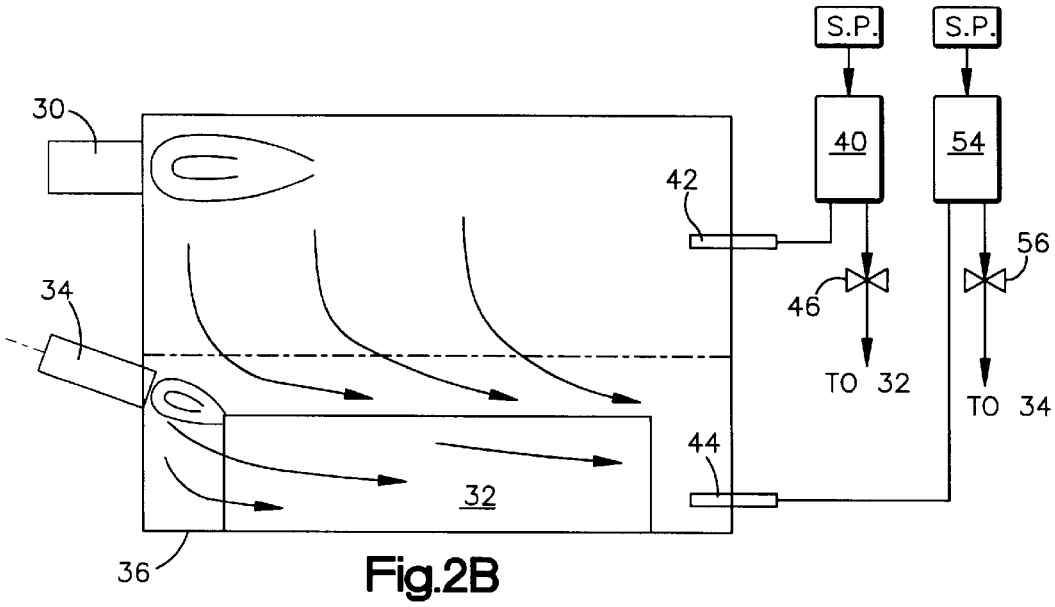

The present invention is directed to a furnace and method of heating where the hot POC's are circulated around the product so as to promote high rates of heat transfer to the furnace load along all its exposed surfaces. As shown in FIGS. 2A and 2B, a primary burner arrangement 30 is used as a heating source for the furnace 10. The primary burners 30 preferably operate substantially at a stoichiometric fuel-to-air ratio, i.e. where oxidant (e.g. air) is supplied in the minimum proportion for complete oxidation of the fuel, which is the most fuel-efficient firing since maximum heat is released. However, as a practical consideration, it is understood that as much as 10% excess air (or its equivalent in $O_2$) can be supplied to insure complete combustion and provide better control of the burner operation without losing much of the benefits of stoichiometric firing. The primary burners 30 create POC's that establish the desired furnace environment, e.g. between 1500–2500° F.

The present invention includes a secondary burner system 34 to disturb the boundary layer adjacent to the product and circulate the hot POC's around the product 32. The secondary burners can be mounted in the side walls or the roof. The preferred embodiment shown in FIGS. 2A and 2B uses a secondary burner arrangement 34, including high velocity, low capacity burners, to produce the necessary circulation. The secondary burners 34 are mounted in the side of the furnace wall at a position close to the product 32. In order to increase circulation to all exposed surfaces of the load, the burners 34 are preferably mounted at an angle above or below horizontal, e.g. plus or minus 45 degrees from horizontal. In the preferred embodiment, the secondary burners 34 are preferably mounted at a depressed angle below horizontal so that they fire generally toward the furnace hearth 36. Burner angle will vary according to the specific requirements of each particular furnace. In this way, a circulation flow pattern is created within the furnace that entrains the hot POC's of the furnace environment to impinge upon the product 32, and in between individual loads of product 32 thereby promoting uniform heating of the product 32 at a higher rate along all its exposed exterior surfaces.

Figure 3:
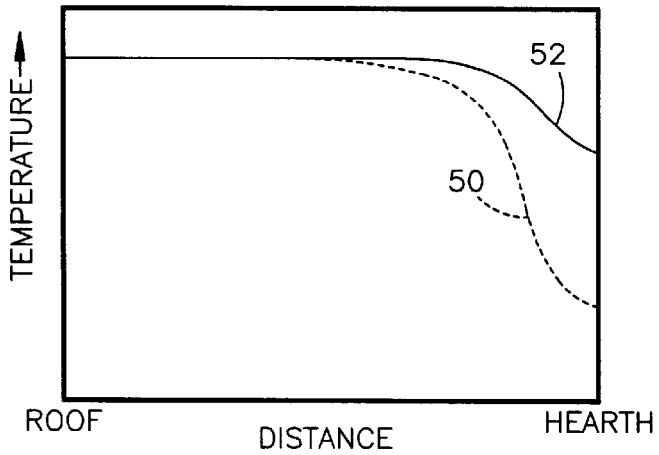
FIG. 3 is a graph illustrating the improvement in thermal distribution for a furnace provided by the present invention.

In the preferred embodiment, the secondary burner is fired with a controlled fuel-to-air ratio of the input, resulting in a desired amount of excess air which adds thermal load to the burner, thereby suppressing the flame temperature of the secondary burners 34. The fuel/air input is added in such a proportion that the flame temperature of the secondary burners 34 preferably matches that of the furnace environment, e.g. 2500° F. (as compared with the 3400° F. flame temperature of the primary burners 30). Operated in this manner, the secondary burners 34 release minimal additional heat into the furnace environment. In this way, the secondary burner flame can impinge directly onto the product 32 for an extended period of time without excessive oxidation or overheating, and thereby entrain a large volume of hot POC's to wash over all the exposed exterior surfaces of the product 32, providing increased rates of heating of the product. FIG. 3 shows potential temperature curves indicating the drop between the roof and the hearth of a furnace. The curve 50 for a conventionally fired furnace shows a significant temperature differential between the roof and the hearth. The curve 52 for the invention shows a minimal temperature differential between the roof and hearth which improves heat transfer and uniformity. Thus, with the present invention the product throughput is greatly increased with reduced furnace residence time. Also, heating of the exposed product surfaces is more uniform, resulting in improved product quality.

As indicated in FIG. 2B, the invention can include a dedicated control system 40 for the temperature of the circulating POC's in and around the product 32 by controlling the fuel input to the secondary burners 34. As an example the control system 40 receives temperature data from a sensor arrangement including a primary thermocouple 42 that measures the temperature within a zone near the top of the furnace and varies fuel input to the primary burners 30 through a primary fuel valve 46. A secondary thermocouple 44 is placed closer to the bottom of the furnace, near the product 32, and is used to detect a setpoint temperature higher than the zone temperature but lower than the material tolerance temperature of the product 32. In the event that setpoint temperature is exceeded in a normal heating operation, a secondary temperature control 54 will vary the position of a secondary fuel valve 56, which will reduce the fuel input to the secondary burner 34, thereby reducing temperature below the setpoint.

The secondary temperature control loop 54 can also operate in an emergency mode if there is a delay in the advancement of product 32 through the furnace. In this instance, impingement of the secondary burner's POC on the product 32 can be prolonged, typically resulting in overheating of the product. In this event, the control system 54 cuts back the fuel input to the secondary burner 34, or increases the excess air to cool the burner exhaust, precluding product overheating during the delay interval.

Figure 4A:
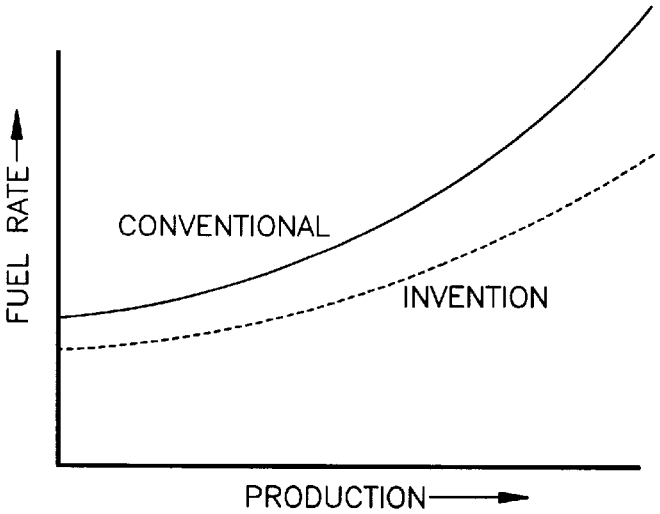
FIGS. 4A and 4B are respective graphs comparing improvements in fuel rate and product quality to production using the present invention.
Figure 4B:
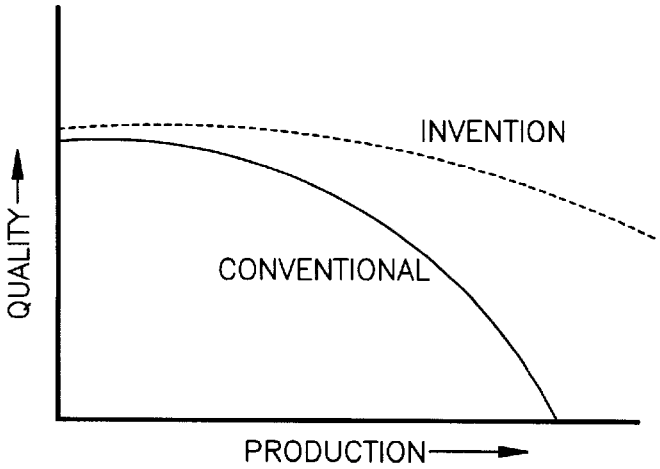

With the invention's control system 40, the excess air in the secondary burners 34 can be varied to the most effective ratio to effect optimum heat transfer to the product 32. In this way, the wasted heat carried up the stack by the flue gas is minimized. This degree of control provides several correlated benefits. By improving heat transfer, total production can be increased along with production per unit of fuel, or total fuel consumption can be reduced while maintaining production (as indicated in FIG. 4A, where the dashed line indicates performance of the present invention). Alternatively, by providing greater uniformity, an improvement in product quality is realized for any production rate (as indicated in FIG. 4B, where the dashed line again indicates performance of the present invention.

As described hereinabove, the present invention solves many problems associated with previous systems, and increases productivity and efficiency. However, it will be appreciated that various changes in the details, materials and/or arrangements of parts herein described and illustrated may be made by those skilled in the art within the principle and scope of the invention as expressed in the appended claims.

What is claimed is:

1. A system for a continuous process of heating loads in a furnace, said system comprising:

a movable structure configured to support the loads in a row in which adjacent loads are spaced from each other, and to advance the row of loads lengthwise along a path of movement extending through the furnace;

a plurality of primary burners which are operative to fire primary flames into the furnace to produce primary products of combustion for heating the loads, said primary burners being spaced apart in a row extending alongside said path of movement and being oriented to project said primary flames in directions extending orthogonally across said path of movement at locations above the loads so as to avoid impingement of said primary flames with the loads; and a plurality of secondary burners which are operative to fire secondary flames into the furnace to produce secondary products of combustion for heating the loads, said secondary burners being spaced apart in a row extending alongside said path of movement at a location between said row of primary burners and the loads, and being oriented to project said secondary flames in directions extending orthogonally across said path of movement at angles inclined downward from said primary flames toward and between the loads so as to entrain said primary products of combustion downward between adjacent loads, and also to entrain said primary products of combustion downward into impingement with the loads, as the loads are advanced past said rows of burners.

2. A furnace heating system as defined in claim 1 wherein said primary burners and said secondary burners are operative simultaneously in a mode in which said primary burners fire at substantially stoichiometric fuel to oxidant ratios and said secondary burners fire at fuel to oxidant ratios having excess oxidant.

3. A furnace heating system as defined in claim 1 wherein said primary burners and said secondary burners are operative simultaneously in a mode in which said primary burners fire at a first flame temperature and said secondary burners fire at a second, lower flame temperature, whereby said secondary burners operate to cause entrainment of said primary products of combustion downward toward the loads without substantially increasing the temperature of said primary products of combustion.

4. A furnace heating system as defined in claim 3 further comprising a primary temperature control apparatus operative to vary fuel flow to said primary burners in response to a temperature at a first location above the loads, and a secondary temperature control apparatus operative to vary fuel flow to said secondary burners in response to a temperature at second location horizontally adjacent to the loads, with said primary temperature control apparatus including a first temperature sensor at said first location, and a first valve operative to vary said fuel flow to said primary burners in response to said first temperature sensor, and with said secondary temperature control apparatus including a second temperature sensor at said second location, and a second valve operative to vary said fuel flow to said secondary burners in response to said second temperature sensor.

5. A continuous process of heating loads in a furnace, said continuous process comprising the steps of:

supporting the loads in a row in which adjacent loads arc spaced from each other, and advancing the row of loads lengthwise along a path of movement extending through the furnace;

operating a plurality of primary burners to fire primary flames into the furnace and thereby to produce primary products of combustion for heating the loads, said primary burners being spaced apart in a row extending alongside said path of movement and being oriented to project said primary flames in directions extending orthogonally across said path of movement at locations above the loads so as to avoid impingement of said primary flames with the loads; and simultaneously operating a plurality of secondary burners to fire secondary flames into the furnace and thereby to produce secondary products of combustion for heating the loads, said secondary burners being spaced apart in a row extending alongside said path of movement at a location between said row of primary burners and the loads, and being oriented to project said secondary flames in directions extending orthogonally across said path of movement at angles inclined downward from said primary flames toward and between the loads so as to entrain said primary products of combustion downward between adjacent loads, and also to entrain said primary products of combustion downward into impingement with the loads, as the loads are advanced past said rows of burners.

6. A continuous process as defined in claim 5 wherein said primary burners are fired at substantially stoichiometric fuel to oxidant ratios and said secondary burners are fired at fuel to oxidant ratios having excess oxidant.

7. A continuous process as defined in claim 5 wherein said primary burners are fired at a first flame temperature and said secondary burners are fired at a second flame temperature lower than first flame temperature, whereby said secondary flames entrain said primary products of combustion downward toward the loads without substantially increasing the temperature of said primary products of combustion.

8. A continuous process as defined in claim 7 further comprising the steps of varying fuel flow to said primary burners in response to a temperature at a first location above the loads, and varying fuel flow to said secondary burners in response to a temperature at a second location horizontally adjacent to the loads, including the steps of operating a first temperature sensor to sense said temperature at said first location and operating a first valve to very said fuel flow to said primary burners in response to said first temperature sensor, and operating a second temperature sensor to sense said temperature at said second location and operating a second valve to vary said fuel flow to said secondary burners in response to said second temperature sensor.

* * * * *

UNITED STATES PATENT AND TRADEMARK OFFICE
CERTIFICATE OF CORRECTION

PATENT NO : 6,113,386

DATED : September 5, 2000

INVENTOR(S) : Robert A. Shannon, et al.

It is certified that error appears in the above-identified patent and that said Letters Patent are hereby corrected as shown below:

Column 4, Line 64 should read as follows:

supporting the loads in a row in which adjacent loads [arc] <u>are</u> and Column 6, Line 19 should read as follows:

location and operating a first valve to [very] <u>vary</u> said fuel flow to

Signed and Sealed this

Fifteenth Day of May, 2001

*Attest:*

Nicholas P. Godici

NICHOLAS P. GODICI

*Attesting Officer*

*Acting Director of the United States Patent and Trademark Office*